US006930605B2

(12) United States Patent
Chen

(10) Patent No.: US 6,930,605 B2
(45) Date of Patent: Aug. 16, 2005

(54) OPERATING STATUS INDICATION METHOD AND SYSTEM

(75) Inventor: Chih-Wei Chen, Taipei (TW)

(73) Assignee: Inventec Corporation, Taipei (TW)

( * ) Notice: Subject to any disclaimer, the term of this patent is extended or adjusted under 35 U.S.C. 154(b) by 105 days.

(21) Appl. No.: 10/704,102

(22) Filed: Nov. 7, 2003

(65) Prior Publication Data

US 2005/0099313 A1 May 12, 2005

(51) Int. Cl.[7] ..... G08B 21/00

(52) U.S. Cl. ..... 340/540; 713/2; 714/48; 714/49; 714/57

(58) Field of Search ..... 340/540; 713/2; 714/48, 49, 57, 10, 45, 23, 34, 55

(56) References Cited

U.S. PATENT DOCUMENTS 4,749,985 A * 6/1988 Corsberg ..... 340/517
5,452,417 A * 9/1995 Randall et al. ..... 345/501
5,619,683 A * 4/1997 Kreft ..... 710/62
5,812,061 A * 9/1998 Simons ..... 340/815.45
6,587,966 B1 * 7/2003 Chaiken et al. ..... 714/34

* cited by examiner

*Primary Examiner*—Brent A. Swarthout
(74) *Attorney, Agent, or Firm*—Fulbright & Jaworski LLP

(57) ABSTRACT

An operating status indication method and system is proposed for use with an embedded operating system. The indication system is linked with and controlled by the operating system. The indication system includes an indication device, a driving module, and a signal control module. When the operating system is functioning properly, the signal control module sends a control signal to the driving module, for allowing the driving module to drive the indication device to output a particular signal, such that users can be informed of the normal operating status of the operating system by the particular signal.

9 Claims, 2 Drawing Sheets

OPERATING STATUS INDICATION METHOD AND SYSTEM

FIELD OF THE INVENTION

The present invention relates to status indication methods and systems, and more particularly, to an operating status indication method and system for use with an embedded operating system to inform users whether the embedded operating system is operating properly or not.

BACKGROUND OF THE INVENTION

An embedded operating system is an independent operating system recorded in a non-volatile memory of a hardware device, and the software thereof is designed to adapt particularly to the hardware device to carry out certain tasks. Applications for the embedded operating system are broad, including common usage in car control devices, home appliances, digital cameras, mobile phones, and network firewall servers to more exotic uses such as in a space shuttle.

Generally speaking, the embedded operating system does not include I/O (input/output) devices such as keyboard, mouse, or display of a standard computer, since the main function of the embedded operating system is not to provide data editing as is provided by the standard computer. Currently, for a normal apparatus that includes a built-in embedded operating system, the only way to determine whether the system has started properly or not after turning on is by observing simple light signals or a LCD panel. For example, for a network firewall server, one can check whether the operating system has successfully booted up or not by means of a status light on the server. When the operating system has started successfully, power is supplied to turn on the status light to indicate the boot-up success.

However, the above status light or LCD panel are controlled by the supporting electronic hardware device, and the on/off status thereof has no direct correlation to the embedded operating system within the device. Therefore, even though the hardware-controlled status light is turned on, this does not indicate for sure that the embedded operating system is operable. Thus the status light does not allow users to definitely recognize whether the embedded operating system is working or down. That is, the users can not surely determine the current operating status of the operating system by observing the status light since the status light may give a false indication as it is not directly linked with a functioning mechanism of the operating system.

In view of the above drawbacks, the problem to be solved herein is to provide an operating status indication method and system, which can be controlled by an embedded operating system to indicate an operating status of the operating system.

SUMMARY OF THE INVENTION

A primary objective of the present invention is to provide an operating status indication method and system, suitable for an embedded operating system linked with the operating status indication system, to inform users whether the operating system is working properly or not.

To achieve the above and other objectives, the present invention proposes a status indication method and system. The operating status indication system linked with an embedded operating system, includes: an indication device for outputting a particular signal to inform users the embedded operating system is operating normally; a driving module for driving the indication device to output the particular signal; and a signal control module controlled by the embedded operating system, the signal control module outputting a control signal to the driving module when the embedded operating system is operating normally so as to allow the driving module to drive the indication device to output the particular signal, and the signal control module failing to output the control signal when the embedded operating system is operating abnormally, such that the driving module fails to drive the indication device to output the particular signal, and the users know the abnormal operating status of the embedded operating system.

The operating status indication method is used for an operating status indication system linked with an embedded operating system, the operating status indication system having at least one indication device to inform users of an operating status of the embedded operating system. This method includes the steps of: having a signal control module of the operating status indication system, which is controlled by the embedded operating system, to output a control signal to a driving module of the operating status indication system when the operating system is operating normally; and shaving the driving module to drive the indication device to output a particular signal to inform the users of the normal operating status of the operating system.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFFERED EMBODIMENTS

Figure 1:
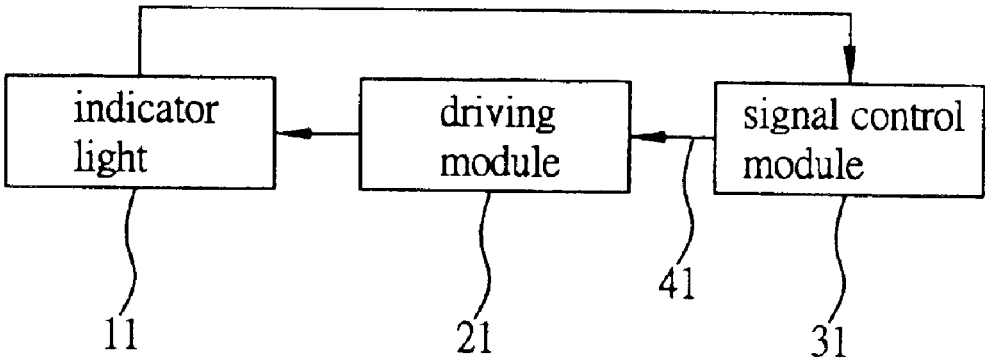
FIG. 1 is a schematic diagram showing basic structural architecture of an operating status indication system according to a preferred embodiment of the invention.

FIG. 1 shows basic structural architecture of an operating status indication system proposed by the present invention. This operating status indication system is suitably used in and linked with an embedded operating system (not shown). The indication system includes an indication device comprising at least one indicator light 11, a driving module 21, and a signal control module 31. The indicator light 11 displays different status indications according to the operating status of the operating system in order to notify users whether the operating status of the system is normal or not. When the operating system is operating normally, the indicator light 11 flashes continually for example; otherwise, when the system is operating abnormally, the indicator light 11 remains in either an on or off status. Therefore, the indication system having the indicator light 11 allows users to determine whether the operating system is operating normally or not by the action of the indicator light 11, wherein either a power-on light (not shown) of the operating system can be used as the indicator light 11, or a separate light can be provided as the indicator light 11.

The indicator light 11 is driven by the driving module 21 comprising a driving circuit, such as a light controller, to which the signal control module 31 for sending out a control signal 41 is coupled. The signal control module 31 is also coupled to the indicator light 11 to periodically read the status of the indicator light 11 to determine whether it is on or off. The signal control module 31 is usually controlled by the operating system. The signal control module 31 can periodically read the status of the indicator light 11 (either on or off) when the operation system periodically counts to a predetermined value of time in order to allow the signal control module 31 to output the control signal 41 according to the status of the indicator light 11, such that it causes the driving module 21 to invert the status of the indicator light 11, either from on to off or from off to on to produce a flashing signal.

Therefore, when the operating system is down or not operating properly, the operating system is not be able to count. Consequently, the operating system can not periodically enable the signal control module 31 to output the control signal 41, such that the indicator light 11 would remain in its current status, that is, either constantly on or constantly off.

Figure 2:
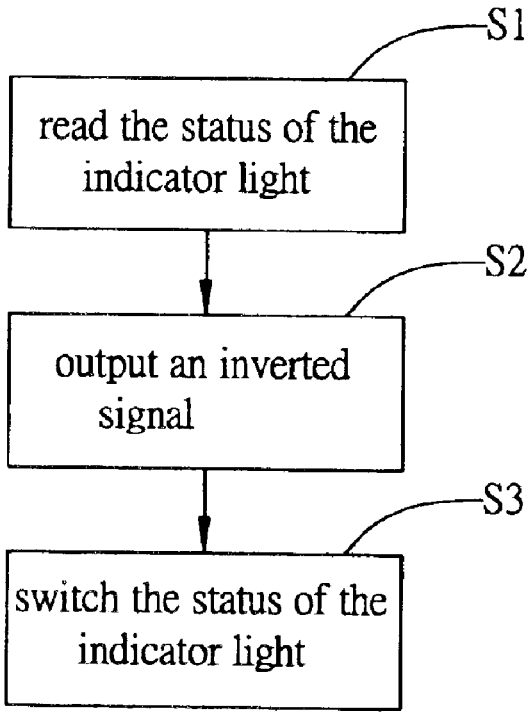
FIG. 2 is a flow chart showing the steps of an operating status indication method according to the invention.

FIG. 2 shows the steps of an operating status indication method according to the invention in the use of the operating status indication system. First, in step S1, in order to provide periodic flashing of the indicator light 11 when the embedded operating system is operating normally, the operating system periodically counts to a predetermined value of time, to allow the signal control module 31 to periodically read the current status of the indicator light 11 to decide whether the next status of the indicator light 11 should be on or off. Next, it proceeds to step S2.

In step S2, the signal control module 31 sends out a control signal 41 according to the status of indicator light 11 read by the signal control module 31, so as to cause the driving module 21 to output an inverted signal to the indicator light 11 for inverting the status of the indicator light 11. Next, it proceeds to step S3.

In step S3, the inverted signal from the driving module 21 prompts the indicator light 11 to switch its status in a way either from on to off or from off to on. In other words, if the status of the indicator light 11 read by the signal control module 31 in step S1 is an on status, the inverted signal allows the indicator light 11 to be switched off. On the other hand, if the status of the indicator light 1 read by the signal control module 31 in step S1 is an off status, the inverted signal allows the indicator light 11 to be switched on.

When the embedded operating system has counted to the predetermined value, the above process from step S1 to step S3 repeats. The magnitude of time set to be counted determines the flashing speed of the indicator light 11. Therefore, when the operating system is operating normally, the signal control module 31 periodically outputs a control signal 41 to cause the driving module 21 to output an inverted signal, such that the indicator light 11 can flash periodically to thereby indicate the normal operating status of the operating system. Otherwise, when the operating system is down, the operating system can not count the time properly and the fails to enable the signal control module 31 to periodically drive the driving module 21 to send out the inverted signal to the indicator light 11, thereby making the indicator light 11 remain in a fixed on or off status.

Figure 3:
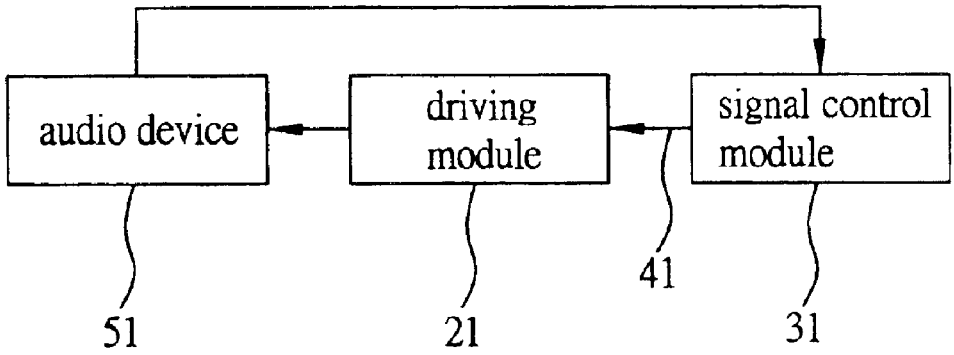
FIG. 3 is a schematic diagram showing basic structural architecture of the operating status indication system according to another preferred embodiment of the invention.

In another embodiment of the present invention, as shown in FIG. 3, the indication device of the operating status indication system comprises at least one audio device 51 such as speaker that can produce different audible alerts according to the operating status of the embedded operating system, to notifying users whether the operating system is operating normally or not. In the typical application, for example, the audio device 51 does not sound when the operating system is operating normally. But in the case when the operating system is abnormal, the audio device 51 emits a warning sound.

Under the normal operating status of the operating system, the signal control signal 31 continuously sends out a prohibiting signal to prohibit the driving module 21 from driving the audio device 51. When the operating system is down, the signal control signal 31 stops sending the prohibiting signal, and the audio device 51 is driven by the driving module 21 to sound continuously and warn the users of the abnormal operating status of the operating system.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. An operating status indication system linked with an embedded operating system, comprising:

an indication device for outputting a particular signal to inform users the embedded operating system is operating normally;

a driving module for driving the indication device to output the particular signal; and a signal control module controlled by the embedded operating system, the signal control module outputting a control signal to the driving module when the embedded operating system is operating normally so as to allow the driving module to drive the indication device to output the particular signal, and the signal control module stopping outputting the control signal when the embedded operating system is operating abnormally, such that the driving module fails to drive the indication device to output the particular signal, and the users know the abnormal operating status of the embedded operating system.

2. The operating status indication system of claim 1, wherein the indication device comprises at least one indicator light.

3. The operating status indication system of claim 2, wherein under the normal operating status of the operating system, the signal control module periodically detects an on/off status of the indicator light and sends out the control signal to the driving module to allow the driving module to drive the indicator light to switch the on/off status thereof, and when the operating system is operating abnormally, the signal control module fails to send the control signal, such that the driving module fails to drive the indicator light, making the indicator light stay in a fixed on or off status.

4. An operating status indication method for use with an operating status indication system linked with an embedded operating system, the operating status indication system having at least one indication device to inform users of an operating status of the embedded operating system, the method comprising the steps of:

having a signal control module of the operating status indication system, which is controlled by the embedded operating system, output a control signal to a driving module of the operating status indication system when the operating system is operating normally; and having the driving module drive the indication device to output a particular signal to inform the users of the normal operating status of the operating system.

5. The operating status indication method of claim 4, wherein the indication device comprises at least one indicator light.

6. The operating status indication method of claim 5, wherein under the normal operating status of the operating system, the signal control module periodically detects an on/off status of the indicator light and sends out the control signal to the driving module to allow the driving module to drive the indicator light to switch the on/off status thereof, and when the operating system is operating abnormally, the signal control module fails to send the control signal, such that the driving module fails to drive the indicator light, making the indicator light stay in a fixed on or off status.

7. An operating status indication system linked with an embedded operating system, comprising:

an indication device for outputting a particular signal to inform users the embedded operating system is operating abnormally;

a driving module for driving the indication device to output the particular signal; and a signal control module controlled by the embedded operating system, the signal control module outputting a prohibiting signal to prohibit the driving module from driving the indication device when the embedded operating system is operating normally, and the signal control module stopping outputting the prohibiting signal when the embedded operating system is operating abnormally, so as to allow the driving module to drive the indication device to output the particular signal and inform the users of the abnormal operating status of the embedded operating system.

8. The operating status indication system of claim 7, wherein the indication device comprises at least one audio device.

9. The operating status indication system of claim 8, wherein under the normal operating status of the operating system, the signal control module continually sends out the prohibiting signal to prohibit the driving module from driving the audio device to sound, and when the operating system is operating abnormally, the signal control module stops sending the prohibiting signal, allowing the audio device to be driven by the driving module and sound.

* * * * *